US011164593B2

(12) United States Patent
Sørensen et al.

(10) Patent No.: US 11,164,593 B2
(45) Date of Patent: Nov. 2, 2021

(54) HEARING DEVICE AND METHOD WITH NON-INTRUSIVE SPEECH INTELLIGIBILITY

(71) Applicant: GN HEARING A/S, Ballerup (DK)

(72) Inventors: Charlotte Sørensen, Jyllinge (DK); Jesper B. Boldt, Ballerup (DK); Angeliki Xenaki, Frederiksberg (DK); Mathew Shaji Kavalekalam, Aalborg (DK); Mads G Christensen, Dronninglund (DK)

(73) Assignee: GN Hearing A/S, Ballerup (DK)

( * ) Notice: Subject to any disclaimer, the term of this patent is extended or adjusted under 35 U.S.C. 154(b) by 0 days.

(21) Appl. No.: 16/011,982

(22) Filed: Jun. 19, 2018

(65) Prior Publication Data

US 2019/0019526 A1 Jan. 17, 2019

(30) Foreign Application Priority Data

Jul. 13, 2017 (EP) ..... 17181107

(51) Int. Cl.
*G10L 21/0364* (2013.01)
*H04R 25/00* (2006.01)
(Continued)

(52) U.S. Cl.
CPC ..... *G10L 21/0364* (2013.01); *G10L 25/60* (2013.01); *H04R 25/00* (2013.01);
(Continued)

(58) Field of Classification Search
CPC .. G10L 21/0208; G10L 19/07; G10L 21/0364
See application file for complete search history.

(56) References Cited

U.S. PATENT DOCUMENTS 5,133,013 A * 7/1992 Munday ..... G10L 21/0208 704/226
7,599,507 B2 10/2009 Hansen
(Continued)

FOREIGN PATENT DOCUMENTS

CN 101853665 A * 10/2010
CN 104703107 A 6/2015
CN 105872923 A 8/2016

OTHER PUBLICATIONS

Parvaneh Janbakhshi, et al., "Pathological Speech Intelligibility Assessment Based On the Short-Time Objective Intelligibility Measure," ICASSP, 2019. (Year: 2019).*
(Continued)

*Primary Examiner* — Feng-Tzer Tzeng
(74) *Attorney, Agent, or Firm* — Vista IP Law Group, LLP

(57) ABSTRACT

A hearing device includes: an input module for provision of a first input signal; a processor configured to provide an electrical output signal based on the first input signal; a receiver configured to provide an audio output signal; and a controller comprising a speech intelligibility estimator configured to determine a speech intelligibility indicator indicative of speech intelligibility based on the first input signal, wherein the controller is configured to control the processor based on the speech intelligibility indicator; wherein the speech intelligibility estimator comprises a decomposition module configured to decompose the first input signal into a first representation of the first input signal in a frequency domain, wherein the first representation comprises one or more elements representative of the first input signal; and wherein the decomposition module comprises one or more characterization blocks for characterizing the one or more elements of the first representation in the frequency domain.

29 Claims, 4 Drawing Sheets

(51) Int. Cl.

| | |
|---|---|
| ***G10L 25/60*** | (2013.01) |
| *G10L 21/0208* | (2013.01) |
| *G10L 19/07* | (2013.01) |
| *G10L 21/0232* | (2013.01) |

(52) U.S. Cl.
CPC ..... *H04R 25/407* (2013.01); *G10L 19/07* (2013.01); *G10L 21/0208* (2013.01); *G10L 21/0232* (2013.01); *H04R 25/405* (2013.01); *H04R 2225/41* (2013.01); *H04R 2225/43* (2013.01)

(56) References Cited

U.S. PATENT DOCUMENTS

| | | | | |
|---|---|---|---|---|
| 10,225,669 | B2 * | 3/2019 | Jensen | H04R 3/005 |
| 2003/0014249 | A1 * | 1/2003 | Ramo | G10L 19/07 704/230 |
| 2005/0141737 | A1 * | 6/2005 | Hansen | G10L 21/0364 381/316 |
| 2013/0218578 | A1 * | 8/2013 | Gao | G10L 19/12 704/500 |

OTHER PUBLICATIONS

Asger Heidemann Andersen, et al. "A Non-Intrusive Short-Time Objective Intelligibility Measure," ICASSP 2017. (Year: 2017).*
Parvaneh Janbakhshi, et al., "Pathological Speech Intelligibility Assessment Based On the Short-Time Objective Intelligibility Measure," ICASSP, 2019 (copy available in the previous Office action). (Year: 2019).*
Asger Heidemann Andersen, et al. "A Non-Intrusive Short-Time Objective Intelligibility Measure," ICASSP 2017 (copy available in the previous Office action). (Year: 2017).*
Extended European Search Report dated Nov. 3, 2017 for corresponding European Application No. 17181107.8.
Charlotte Sorensen, et al. "Pitch-based Non-Intrusive Objective Intelligibility Prediction" 2017 IEEE International Conference On Acoustics, Speech and Signal Processing, Mar. 1, 2017, pp. 386-390.
Asger Heidmann Andersen, Et al. "A Non-Intrusive Short-Time Objective Intelligibility Measure" 2017 IEEE International Conference On Acoustics, Speech and Signal Processing, Mar. 5, 2017. pp. 5085-5089.
Kavalekalam Mathew Shaji, Et al. "Kalman Filter for speech enhancement in cocktail party scenarios using a codebook-based approach". 2016 IEEE International Conference On Acoustics, Speech and Signal Processing, Mar. 20, 2016. pp. 191-195.
Srinivasan S, Et al., "Codebook-based Bayesian Speech Enhancement" 2005 IEEE International Conference On Acoustics, Speech and Signal Processing- 18-23, vol. 1, Mar. 18, 2005.
Falk Tiago H, Et al. "Objective Quality and Intelligibility Prediction for Users of Assistive Listening Devices: Advantages and Limitations of Existing tools", IEEE Signal Processing Magazine, IEE Service Center, Piscataway, NJ, vol. 32, No. 2, Mar. 1, 2015, pp. 114-124.
Toshihiro Sakano, Et al. "A Speech Intelligibility Estimation Method Using a Non-Reference Feature Set" IEICE Transactions on Information and System., vol. e98-D, No. 1, Jan. 1, 2015, pp. 21-28.
Sorensen, Charlotte, et al. "Non-intrusive codebook-based intelligibility prediction." Speech Communication 101 (2018): 85-93.
Sorensen, Charlotte, et al. "Non-intrusive intelligibility prediction using a codebook-based approach." EUSIPCO. 2017.
Catellier, Andrew A., and Stephen D. Voran. "Wawenets: A no-reference convolutional waveform-based approach to estimating narrowband and wideband speech quality." ICASSP 2020-2020 IEEE International Conference on Acoustics, Speech and Signal Processing (ICASSP). IEEE, 2020.
Foreign Office Action dated Sep. 29, 2020 for related European Appln. No. 17181107.8.
Foreign Office Action dated Jan. 29, 2021 for related Chinese Appln. No. 201810756892.6.
Sorensen, Charlotte, et al. "Pitch-based non-intrusive objective intelligibility prediction." 2017 IEEE International Conference on Acoustics, Speech and Signal Processing (ICASSP). IEEE, 2017.
Foreign Office Action for CN Patent Appln. No. 201810756892.6 dated Jul. 28, 2021.
Translation of office action dated Jul. 28, 2021 for Chinese Patent Application No. 201810756892.6.

* cited by examiner

HEARING DEVICE AND METHOD WITH NON-INTRUSIVE SPEECH INTELLIGIBILITY

This application claims priority to, and the benefit of, European Patent Application No. 17181107 filed on Jul. 13, 2017. The entire disclosure of the above application is expressly incorporated by reference herein.

RELATED APPLICATION DATA

This application claims priority to, and the benefit of, European Patent Application No. 17181107 filed on Jul. 13, 2017, pending. The entire disclosure of the above application is expressly incorporated by reference herein.

FIELD

The present disclosure relates to a hearing device, and a method of operating a hearing device.

BACKGROUND

Generally, the speech intelligibility for users of assistive listening devices depends highly on the specific listening environment. One of the main issues encountered by hearing aid (HA) users is severely degraded speech intelligibility in noisy multi-talker environments such as the "cocktail party problem".

To assess speech intelligibility, various intrusive methods exist to predict the speech intelligibility with acceptable reliability, such as the short-time objective intelligibility (STOI) metric and the normalized covariance metric (NCM).

However, the STOI method, and the NCM method are intrusive, i.e., they all require access to the "clean" speech signal. However, in most real-life situations, such as the cocktail party, access to the "clean" speech signal as reference speech signal is rarely available.

SUMMARY

Accordingly, there is a need for hearing devices, methods and hearing systems that overcome drawbacks of the background.

A hearing device is disclosed. The hearing device comprises an input module for provision of a first input signal, the input module comprising a first microphone; a processor for processing input signals and providing an electrical output signal based on input signals; a receiver for converting the electrical output signal to an audio output signal; and a controller operatively connected to the input module. The controller comprises a speech intelligibility estimator for estimating a speech intelligibility indicator indicative of speech intelligibility based on the first input signal. The controller may be configured to control the processor based on the speech intelligibility indicator. The speech intelligibility estimator comprises a decomposition module for decomposing the first input signal into a first representation of the first input signal, e.g. in a frequency domain. The first representation may comprise one or more elements representative of the first input signal. The decomposition module may comprise one or more characterization blocks for characterizing the one or more elements of the first representation e.g. in the frequency domain.

Further, a method of operating a hearing device is provided. The method comprises converting audio to one or more microphone input signals including a first input signal; obtaining a speech intelligibility indicator indicative of speech intelligibility related to the first input signal; and controlling the hearing device based on the speech intelligibility indicator. Obtaining the speech intelligibility indicator comprises obtaining a first representation of the first input signal in a frequency domain by determining one or more elements of the representation of the first input signal in the frequency domain using one or more characterization blocks.

It is an advantage of the present disclosure that it allows to assess the speech intelligibility without having a reference speech signal available. The speech intelligibility is advantageously estimated by decomposing the input signals using one or more characterization blocks into a representation. The representation obtained enables reconstruction of a reference speech signal, and thereby leads to an improved assessment of the speech intelligibility. In particular, the present disclosure exploits the disclosed decomposition, and disclosed representation to improve accuracy of the non-intrusive estimation of the speech intelligibility in the presence of noise.

A hearing device includes: an input module for provision of a first input signal, the input module comprising a first microphone; a processor for processing the first input signal and providing an electrical output signal based on the first input signal; a receiver for converting the electrical output signal to an audio output signal; and a controller operatively connected to the input module, the controller comprising a speech intelligibility estimator configured to determine a speech intelligibility indicator indicative of speech intelligibility based on the first input signal, wherein the controller is configured to control the processor based on the speech intelligibility indicator; wherein the speech intelligibility estimator comprises a decomposition module configured to decompose the first input signal into a first representation of the first input signal in a frequency domain, wherein the first representation comprises one or more elements representative of the first input signal; and wherein the decomposition module comprises one or more characterization blocks for characterizing the one or more elements of the first representation in the frequency domain.

Optionally, the decomposition module is configured to decompose the first input signal into the first representation by mapping a feature of the first input signal to the one or more characterization blocks.

Optionally, the decomposition module is configured to map the feature of the first input signal to the one or more characterization blocks by comparing the feature with the one or more characterization blocks, and deriving the one or more elements of the first representation based on the comparison.

Optionally, the one or more characterization blocks comprise one or more target speech characterization blocks.

Optionally, the one or more characterization blocks comprise one or more noise characterization blocks.

Optionally, the decomposition module is configured to decompose the first input signal into the first representation by comparing a feature of the first input signal with one or more target speech characterization blocks and/or one or more noise characterization blocks, and determining the one or more elements of the first representation based on the comparison.

Optionally, the decomposition module is configured to determine a second representation of the first input signal, wherein the second representation comprises one or more elements representative of the first input signal, and wherein the decomposition module is also configured to characterize the one or more elements of the second representation.

Optionally, the decomposition module is configured to determine the second representation by comparing a feature of the first input signal with one or more target speech characterization blocks and/or one or more noise characterization blocks, and determining the one or more elements of the second representation based on the comparison.

Optionally, the hearing device is configured to train the one or more characterization blocks.

Optionally, the one or more characterization blocks are a part of a codebook, and/or a dictionary.

A method of operating a hearing device, includes: converting sound to one or more microphone signals including a first input signal; obtaining a speech intelligibility indicator indicative of speech intelligibility related to the first input signal; and controlling the hearing device based on the speech intelligibility indicator, wherein the act of obtaining the speech intelligibility indicator comprises obtaining a first representation of the first input signal in a frequency domain by determining one or more elements of the first representation of the first input signal in the frequency domain using one or more characterization blocks.

Optionally, the act of determining the one or more elements of the first representation of the first input signal using the one or more characterization blocks comprises mapping a feature of the first input signal to the one or more characterization blocks.

Optionally, the act of obtaining the speech intelligibility indicator comprises generating a reconstructed reference speech signal based on the first representation, and determining the speech intelligibility indicator based on the reconstructed reference speech signal.

Optionally, the one or more characterization blocks comprise one or more target speech characterization blocks.

Optionally, the one or more characterization blocks comprise one or more noise characterization blocks.

Other features will be described in the detailed description.

BRIEF DESCRIPTION OF THE DRAWINGS

The above and other features and advantages will become readily apparent to those skilled in the art by the following detailed description of exemplary embodiments thereof with reference to the attached drawings, in which.

DETAILED DESCRIPTION

Figure 1:
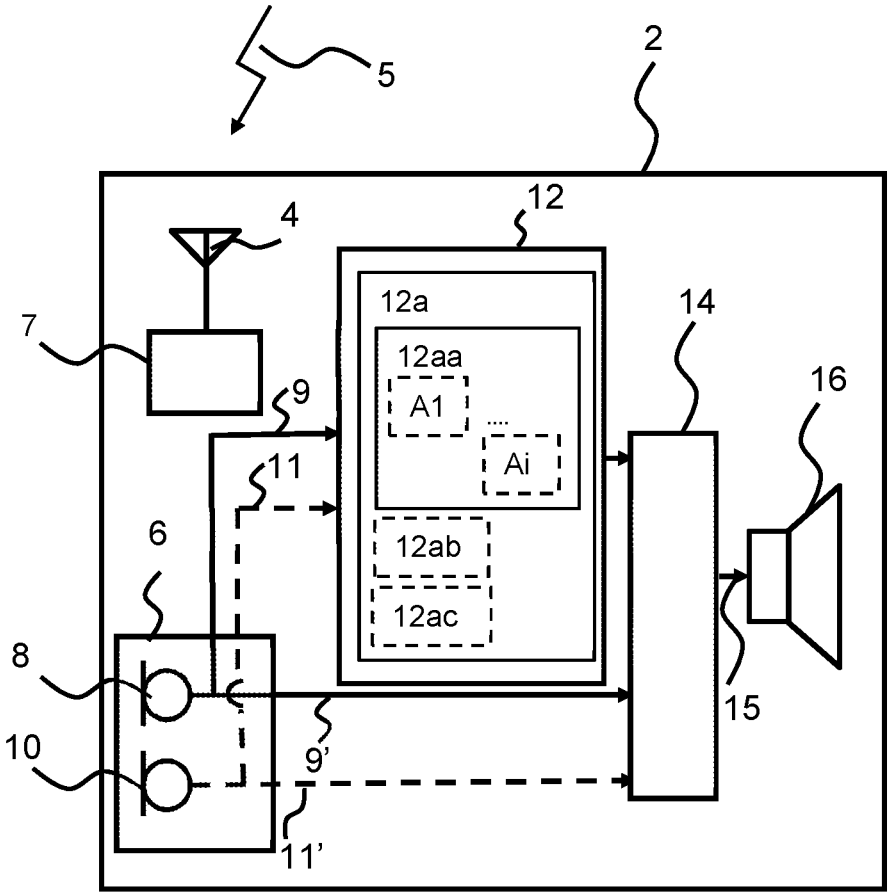
FIG. 1 schematically illustrates an exemplary hearing device according to the disclosure, FIG. 2 schematically illustrates an exemplary hearing device according to the disclosure, wherein the hearing device includes a first beamformer.

Various exemplary embodiments and details are described hereinafter, with reference to the figures when relevant. It should be noted that the figures may or may not be drawn to scale and that elements of similar structures or functions are represented by like reference numerals throughout the figures. It should also be noted that the figures are only intended to facilitate the description of the embodiments. They are not intended as an exhaustive description of the invention or as a limitation on the scope of the invention. In addition, an illustrated embodiment needs not have all the aspects or advantages shown. An aspect or an advantage described in conjunction with a particular embodiment is not necessarily limited to that embodiment and can be practiced in any other embodiments even if not so illustrated, or if not so explicitly described.

Speech intelligibility metrics are intrusive, i.e., they require a reference speech signal, which is rarely available in real-life applications. It has been suggested to derive a non-intrusive intelligibility measure for noisy and nonlinearly processed speech, i.e. a measure which can predict intelligibility from a degraded speech signal without requiring a clean reference signal. The suggested measure estimates clean signal amplitude envelopes in the modulation domain from the degraded signal. However, the measure in such an approach does not allow to reconstruct the clean reference signal and does not perform sufficiently accurate compared to the original intrusive STOI measure. Further, the measure in such an approach performs poorly in complex listening environment, e.g. with a single competing speaker.

The disclosed hearing device and methods propose to determine a representation estimated in the frequency domain from the (noisy) input signal. The representation may be for example a spectral envelope. The representation disclosed herein is determined using one or more predefined characterizations blocks. The one or more characterization blocks are defined and computed so that they fit or represent sufficiently well the noisy speech signal, and support a reconstruction of the reference speech signal. This results in a representation that is sufficient to be considered as a representation of the reference speech signal, and that enables reconstruction of the reference speech signal to be used for the assessment of the speech intelligibility indicator.

The present disclosure provides a hearing device that non-intrusively estimates the speech intelligibility of the listening environment by estimating a speech intelligibility indicator based on a representation of the (noisy) input signal. The present disclosure proposes to use the estimated speech intelligibility indicator to control the processing of input signals.

It is an advantage of the present disclosure that no access to a reference speech signal is needed in the present disclosure to estimate the speech intelligibility indicator. The present disclosure proposes a hearing device and a method that is capable of reconstructing the reference speech signal (i.e. a reference speech signal representing the intelligibility of the speech signal) based on a representation of the input signal (i.e. the noisy input signal). The present disclosure overcomes the lack of availability or lack of access to a reference speech signal by exploiting the input signals, and features of the input signals, such as the frequency or the spectral envelop, or autoregressive parameters thereof, and characterization blocks to derive a representation of the input signal, such as a spectral envelope of the reference speech signal, without access to the reference speech signal.

A hearing device is disclosed. The hearing device may be a hearing aid, wherein the processor is configured to compensate for a hearing loss of a user. The hearing device may be a hearing aid, e.g. of a behind-the-ear (BTE) type, in-the-ear (ITE) type, in-the-canal (ITC) type, receiver-in-canal (RIC) type or receiver-in-the-ear (RITE) type. The hearing device may be a hearing aid of the cochlear implant type, or of the bone anchored type.

The hearing device comprises an input module for provision of a first input signal, the input module comprising a first microphone, such as a first microphone of a set of microphones. The input signal is for example an acoustic sound signal processed by a microphone, such as a first microphone signal. The first input signal may be based on the first microphone signal. The set of microphones may comprise one or more microphones. The set of microphones comprises a first microphone for provision of a first microphone signal and/or a second microphone for provision of a second microphone signal. A second input signal may be based on the second microphone signal. The set of microphones may comprise N microphones for provision of N microphone signals, wherein N is an integer in the range from 1 to 10. In one or more exemplary hearing devices, the number N of microphones is two, three, four, five or more. The set of microphones may comprise a third microphone for provision of a third microphone signal.

The hearing device comprises a processor for processing input signals, such as microphone signal(s). The processor is configured to provides an electrical output signal based on the input signals to the processor. The processor may be configured to compensate for a hearing loss of a user.

The hearing device comprises a receiver for converting the electrical output signal to an audio output signal. The receiver may be configured to convert the electrical output signal to an audio output signal to be directed towards an eardrum of the hearing device user.

The hearing device optionally comprises an antenna for converting one or more wireless input signals, e.g. a first wireless input signal and/or a second wireless input signal, to an antenna output signal. The wireless input signal(s) origin from external source(s), such as spouse microphone device(s), wireless TV audio transmitter, and/or a distributed microphone array associated with a wireless transmitter.

The hearing device optionally comprises a radio transceiver coupled to the antenna for converting the antenna output signal to a transceiver input signal. Wireless signals from different external sources may be multiplexed in the radio transceiver to a transceiver input signal or provided as separate transceiver input signals on separate transceiver output terminals of the radio transceiver. The hearing device may comprise a plurality of antennas and/or an antenna may be configured to be operate in one or a plurality of antenna modes. The transceiver input signal comprises a first transceiver input signal representative of the first wireless signal from a first external source.

The hearing device comprises a controller. The controller may be operatively connected to the input module, such as to the first microphone, and to the processor. The controller may be operatively connected to a second microphone if present. The controller may comprise a speech intelligibility estimator for estimating a speech intelligibility indicator indicative of speech intelligibility based on the first input signal. The controller may be configured to estimate the speech intelligibility indicator indicative of speech intelligibility. The controller is configured to control the processor based on the speech intelligibility indicator.

In one or more exemplary hearing devices, the processor comprises the controller. In one or more exemplary hearing devices, the controller is collocated with the processor.

The speech intelligibility estimator may comprise a decomposition module for decomposing the first microphone signal into a first representation of the first input signal. The decomposition module may be configured to decompose the first microphone signal into a first representation in the frequency domain. For example, the decomposition module may be configured to determine the first representation based on the first input signal, e.g. the first representation in the frequency domain. The first representation may comprise one or more elements representative of the first input signal, such as one or more elements in the frequency domain. The decomposition module may comprise one or more characterization blocks for characterizing the one or more elements of the first representation, such as in the frequency domain.

The one or more characterization blocks may be seen as one or more frequency-based characterization blocks. In other words, the one or more characterization blocks may be seen as one or more characterization blocks in the frequency domain. The one or more characterization blocks may be configured to fit or represent the noisy speech signal, e.g. with minimized error. The one or more characterization blocks may be configured to support a reconstruction of the reference speech signal.

The term "representation" as used herein refers to one or more elements characterizing and/or estimating a property of an input signal. The property may be reflected or estimated by a feature extracted from the input signal, such as a feature representative of the input signal. For example, a feature of the first input signal may comprise a parameter of the first input signal, a frequency of the first input signal, a spectral envelop of the first input signal and/or a frequency spectrum of the first input signal. A parameter of the first input signal may be an auto-regressive, AR, coefficient of an auto-regressive model.

In one or more exemplary hearing devices, the one or more characterization blocks form part of a codebook, and/or a dictionary. For example, the one or more characterization blocks form part of a codebook in the frequency domain or a dictionary in the frequency domain.

For example, the controller or the speech intelligibility estimator may be configured to estimate the speech intelligibility indicator based on the first representation, which enables the reconstruction of the reference speech signal. Stated differently, the speech intelligibility indicator is predicted by the controller or the speech intelligibility estimator based on the first representation as a representation sufficient for reconstructing the reference speech signal.

In an illustrative example where the disclosed technique is applied, an additive noise model is assumed to be part of the (noisy) first input signal where:

$$y(n)=s(n)+w(n), \tag{1}$$

where y(n), s(n) and w(n) represent the first input signal (e.g. a noisy sample speech signal from the input module), the reference speech signal and the noise, respectively. The reference speech signal can be modelled as a stochastic autoregressive, AR, process e.g.:

$$s(n)=\Sigma_{i=1}^{P}a_{s_i}(n)s(n-i)+u(n)=a_s(n)^T s(n-1)+u(n), \tag{2}$$

where $s(n-1)=[s(n-1), \ldots, s(n-P)]^T$ represents the P past reference speech sample signals, $a_s(n)=[a_{s_1}(n), a_{s_2}(n), \ldots, a_{s_p}(n)]^T$ is a vector containing speech linear prediction coefficients for the reference speech signal, LPC, and u(n) is zero mean white Gaussian noise with excitation variance $\sigma_u^2(n)$. Similarly, the noise signal can be modeled e.g.:

$$w(n)=\Sigma_{i=1}^{Q}a_{w_i}(n)w(n-i)+v(n)=a_w(n)^T w(n-1)+v(n), \tag{3}$$

where $w(n-1)=[w(n-1), \ldots, w(n-Q)]^T$ represents the Q past noise sample signal, $a_w(n)=[a_{w_1}(n), a_{w_2}(n) \ldots, a_{w_Q}(n)]^T$ is a vector containing speech linear prediction coefficients for the noise signal, and v(n) is zero mean white Gaussian noise with excitation variance $\sigma_v^2(n)$.

In one or more exemplary hearing devices, the hearing device is configured to model the input signals using an autoregressive, AR, model.

In one or more exemplary hearing devices, the decomposition module may be configured to decompose the first input signal into the first representation by mapping a feature of the first input signal into one or more characterization blocks, e.g. using a projection of a frequency-based feature of the first input signal. For example, the decomposition module may be configured to map a feature of the first input signal into one or more characterization blocks using an autoregressive model of the first input signal with linear prediction coefficients relating the frequency-based feature of the first input signal to the one or more characterization blocks of the decomposition module.

In one or more exemplary hearing devices, mapping the feature of the first input signal into the one or more characterization blocks may comprise comparing the feature with one or more characterization blocks and deriving the one or more elements of the first representation based on the comparison. For example, the decomposition module may be configured to compare a frequency-based feature of the first input signal with the one or more characterization blocks by estimating a minimum mean square error of the linear prediction coefficients and of excitation co-variances related to the first input signal for each of the characterization blocks.

In one or more exemplary hearing devices, the one or more characterization blocks may comprise one or more target speech characterization blocks. For example, the one or more target speech characterization blocks may form part of a target speech codebook in the frequency domain or a target speech dictionary in the frequency domain.

In one or more exemplary hearing devices, a characterization block may be an entry of a codebook or an entry of a dictionary.

In one or more exemplary hearing devices, the one or more characterization blocks may comprise one or more noise characterization blocks. For example, the one or more noise characterization blocks may form part of a noise codebook in the frequency domain or a noise dictionary in the frequency domain.

In one or more exemplary hearing devices, the decomposition module is configured to determine the first representation by comparing the feature of the first input signal with the one or more target speech characterization blocks and/or the one or more noise characterization blocks and determining the one or more elements of the first representation based on the comparison. For example, the decomposition module is configured to determine the one or more elements of the first representation as estimated coefficients related to the first input signal for each of the one or more of the target speech characterization blocks and/or for each of the one or more of the noise characterization blocks. For example, the decomposition module may be configured to map a feature of the first input signal into the one or more target speech characterization blocks and the one or more of the noise characterization blocks using an autoregressive model of the first input signal with linear prediction coefficients relating a frequency-based feature of the first input signal to the one or more target speech characterization blocks and/or to the one or more noise characterization blocks. For example, the decomposition module may be configured to compare a frequency-based feature of the estimated reference speech signal with the one or more characterization blocks by estimating a minimum mean square error of the linear prediction coefficients and of excitation co-variances related to estimated reference speech signal for each of the one or more target speech characterization blocks and/or each of the one or more noise characterization blocks.

In one or more exemplary hearing devices, the first representation may comprise a reference signal representation. In other words, the first representation may be related to a reference signal representation, such as a representation of the reference signal, e.g. of the reference speech signal. The reference speech signal may be seen as to a reference signal representing the intelligibility of the speech signal accurately. In other words, the reference speech signal exhibits similar properties as the signal emitted by an audio source, such as sufficient information about the speech intelligibility.

In one or more exemplary hearing devices, the decomposition module is configured to determine the one or more elements of the reference signal representation as estimated coefficients related to an estimated reference speech signal for each of the one or more of the characterization blocks (e.g. target speech characterization blocks). For example, the decomposition module may be configured to map a feature of the estimated reference speech signal into one or more characterization blocks (e.g. target speech characterization blocks) using an autoregressive model of the first input signal with linear prediction coefficients relating a frequency-based feature of the estimated reference speech signal to the one or more characterization blocks (e.g. target speech characterization blocks). For example, the decomposition module may be configured to compare a frequency-based feature (e.g. a spectral envelope) of the estimated reference speech signal with the one or more characterization blocks (e.g. target speech characterization blocks) by estimating a minimum mean square error of the linear prediction coefficients and of excitation co-variances related to estimated reference speech signal for each of the one or more characterization blocks (e.g. target speech characterization blocks).

In one or more exemplary hearing devices, the decomposition module is configured to decompose the first input signal into a second representation of the first input signal, wherein the second representation comprises one or more elements representative of the first input signal. The decomposition module may comprise one or more characterization blocks for characterizing the one or more elements of the second representation.

In one or more exemplary hearing devices, the second representation may comprise a representation of a noise signal, such as a noise signal representation.

In one or more exemplary hearing devices, the decomposition module is configured to determine the second representation by comparing the feature of the first input signal with the one or more target speech characterization blocks and/the one or more noise characterization blocks and determining the one or more elements of the second representation based on the comparison. For example, when the second representation is targeted at representing the estimated noise signal, the decomposition module is configured to determine the one or more elements of the second representation as estimated coefficients related to the estimated noise signal for each of the one or more of the noise characterization blocks. For example, the decomposition module may be configured to map a feature of the estimated noise signal into the one or more of the noise characterization blocks using an autoregressive model of the estimated noise signal with linear prediction coefficients relating a frequency-based feature of the estimated noise signal to the one or more noise characterization blocks. For example, the decomposition module may be configured to compare a frequency-based feature of the estimated noise signal with the one or more noise characterization blocks by estimating a minimum mean square error of the linear prediction coefficients and of excitation co-variances related to the estimated noise signal for each of the one or more noise characterization blocks.

In one or more exemplary hearing devices, the decomposition module is configured to determine the first representation as a reference signal representation and the second representation as a noise signal representation by comparing the feature of the first input signal with the one or more target speech characterization blocks and the one or more noise characterization blocks and determining the one or more elements of the first representation and the one or more elements of the second representation based on the comparisons. For example, the decomposition module is configured to determine the reference signal representation and the noise signal representation by comparing the feature of the first input signal with the one or more target speech characterization blocks and the one or more noise characterization blocks and determining the one or more elements of the reference signal representation and the one or more elements of the noise signal representation based on the comparisons.

In an illustrative example where the disclosed technique is applied, the first representation is considered to comprise an estimated frequency spectrum of the reference speech signal. The second representation comprises an estimated frequency spectrum of the noise signal. The first representation and the second representation are estimated from linear prediction coefficients and excitation variances concatenated in an estimation vector $\theta=[a_s a_w \sigma_u^2(n)\sigma_v^2(n)]$. The first representation and the second representation are estimated using a target speech codebook comprising one or more target speech characterization blocks and/or a noise codebook comprising one or more noise characterization blocks. The target speech codebook and/or a noise codebook may be trained by the hearing device using a-priori training data or live training data. The characterization blocks may be seen as related to the spectral shape(s) of the reference speech signal or the spectral shape(s) of the first input signal in the form of linear prediction coefficients. Given the observed vector of the first input signal $y=[y(0)\ y(1)\ \ldots\ y(N-1)]$ for the current frame of length N, the minimum mean square error, MMSE, estimate of the vector $\theta$ may be given as $\hat{\theta}=E(\theta|y)$ for the space of the parameters to be estimated, $\Theta$, and may be reformulated using Bayes' theorem as e.g.:

$$\hat{\theta} = \int_{\Theta} \theta p(\theta|y)d\theta = \int_{\Theta} \theta \frac{p(y|\theta)p(\theta)}{p(y)} d\theta. \tag{4}$$

The estimation vector, $\theta_{ij}=[a_{s_i} a_{w_j} \sigma_{u,i\,j}^{2,ML}(n)\sigma_{v,i\,j}^{2,ML}(N)]$, may be defined for each $i^{th}$ entry of the target speech characterization blocks and $j^{th}$ entry of the noise characterization blocks, respectively. The maximum likelihood, ML, estimates of the target speech excitation variance, $\sigma_{u,i\,j}^{2,ML}$, and the ML estimates of of the noise excitation variance $\sigma_{v,i\,j}^{2,ML}$, respectively, may be given as e.g.:

$$C\begin{bmatrix}\sigma_{u,ij}^{2,ML}\\ \sigma_{v,ij}^{2,ML}\end{bmatrix} = D, \tag{5}$$

where $$C = \begin{bmatrix} \left\|\frac{1}{P_y^2(\omega)|A_s^i(\omega)|^5}\right\| & \left\|\frac{1}{P_y^2(\omega)|A_s^i(\omega)|^2|A_w^j(\omega)|^2}\right\| \\ \left\|\frac{1}{P_y^2(\omega)|A_s^i(\omega)|^2|A_w^j(\omega)|^2}\right\| & \left\|\frac{1}{P_y^2(\omega)|A_w^j(\omega)|^4}\right\| \end{bmatrix} \tag{6}$$

$$D = \begin{bmatrix} \left\|\frac{1}{P_y^2(\omega)|A_s^i(\omega)|^2}\right\| \\ \left\|\frac{1}{P_y^2(\omega)|A_w^j(\omega)|^2}\right\| \end{bmatrix}$$

where $A_s^i$ and $A_w^j$ are the frequency spectra of the $i^{th}$ and $j^{th}$ vector, i.e. the $i^{th}$ target speech characterization block and $j^{th}$ noise characterization block. The target speech characterization blocks may form part of a target speech codebook and the noise characterization block may form part of a noise codebook. Also it is assumed that $\|f(\omega)\|=\int|f(\omega)|d\omega$. The spectral envelope of the target speech codebook, the noise codebook and the first input signal are given by $$\frac{1}{|A_s^i(\omega)|^2}, \frac{1}{|A_w^j(\omega)|^2}$$

and $P_y(\omega)$, respectively. In practice, the MMSE estimate of the estimation vector $\theta$ in Eq. 4 is evaluated as a weighted linear combination of $\theta_{i\,j}$ by e.g.:

$$\hat{\theta} = \frac{1}{N_s N_w} \sum_{i=1}^{N_s} \sum_{j=1}^{N_w} \theta_{ij} \frac{p(y|\theta_{ij})p(\sigma_{u,ij}^{2,ML})p(\sigma_{v,ij}^{2,ML})}{p(y)}, \tag{7}$$

where $N_s$ and $N_w$ are number of target speech characterization blocks and noise characterization blocks respectively. $N_s$ and $N_w$ may be seen as number of entries in the target speech codebook and in the noise codebook, respectively. The weight of the MMSE estimate of the first input signal, $p(y|\theta_{i\,j})$, can be computed as e.g.:

$$p(y|\theta_{ij}) = e^{-d_{IS}\left(P_y(\omega), \hat{P}_y^{ij}(\omega)\right)} \tag{8}$$

$$\hat{P}_y^{ij}(\omega) = \frac{\sigma_{u,ij}^{2,ML}}{|A_s^i(\omega)|^2} + \frac{\sigma_{v,ij}^{2,ML}}{|A_w^j(\omega)|^2} \tag{9}$$

$$p(y) = \frac{1}{N_S N_w} \sum_{i=1}^{N_s} \sum_{j=1}^{N_w} p(y|\theta_{ij})p(\sigma_{u,ij}^2)p(\sigma_{v,ij}^2), \tag{10}$$

where the Itakura-Saito distortion between the first input signal (or noisy spectrum) and the modelled first input signal (or modelled noisy spectrum) is given by $d_{IS}(P_y(\omega), \hat{P}_y^{i\,j}(\omega))$. The weighted summation of the LPC is optionally performed in the line spectral frequency domain e.g. in order to ensure stable inverse filters. The line spectral frequency domain is a specific representation of the LPC coefficients having mathematical and numerical benefits. As an example, the LPC coefficient is a low-order spectral approximation—they define the overall shape of the spectrum. If we want to find the spectrum in between two set of LPC coefficients, we need to transfer from LPC→LSF, find the average, and transfer LSF→LPC. Thus, the line spectral frequency domain is a more convenient (but identical) representation of the information of the LPC coefficients. The pair LPC and LSF are similar to the pair Cartesian and polar coordinates.

In one or more exemplary hearing devices, the hearing device is configured to train the one or more characterization blocks. For example, the hearing device is configured to train the one or more characterization blocks using a female voice, and/or a male voice. It may be envisaged that the hearing device is configured to train the one or more characterization blocks at manufacturing, or at the dispenser. Alternatively, or additionally, it may be envisaged that the hearing device is configured to train the one or more characterization blocks continuously. The hearing device is optionally configured to train the one or more characterization blocks so as to obtain representative characterization blocks that enable an accurate first representation, which in turn allows a reconstruction of the reference speech signal. For example, the hearing device may be configured to train the one or more characterization blocks using an autoregressive, AR, model.

In one or more exemplary hearing devices, the speech intelligibility estimator comprises a signal synthesizer for generating a reconstructed reference speech signal based on the first representation (e.g. a reference signal representation). The speech intelligibility indicator may be estimated based on the reconstructed reference speech signal. For example, the signal synthesizer may be configured to generate the reconstructed reference speech signal based on the first representation being a reference signal representation.

In one or more exemplary hearing devices, the speech intelligibility estimator comprises a signal synthesizer for generating a reconstructed noise signal based on the second representation. The speech intelligibility indicator may be estimated based on the reconstructed noisy speech signal. For example, the signal synthesizer may be configured to generate the reconstructed noisy speech signal based on the second representation being a noise signal representation, and/or the first representation being a reference signal representation.

In an illustrative example where the disclosed technique is applied, the reference speech signal may be reconstructed in the following exemplary manner. The first representation comprises an estimated frequency spectrum of the reference speech signal. The second representation comprises an estimated frequency spectrum of the noise signal. In other words, the first representation is a reference signal representation and the second representation is a noise signal representation. The first representation, in this example, comprises a time-frequency, TF, spectrum of the estimated reference signal, $\hat{S}$. The first representation comprises one or more estimated AR filter coefficients $a_s$ of the reference speech signal for each time frame. The reconstructed reference speech signal may be obtained based on the first representation by e.g.:

$$\hat{S}(\omega) = \frac{\hat{\sigma}_u^2}{\left|\hat{A}_s(\omega)\right|^2}, \tag{11}$$

where $\hat{A}_s(\omega)=\Sigma_{k=0}^{P}\hat{a}_{s_k}e^{-j\omega k}$. The second representation, in this example, comprises a time-frequency, TF, power spectrum of the estimated noise signal, $\hat{W}$. The second representation comprises estimated noise AR filter coefficients, $a_w$, of the estimated noise signal that compose a TF spectrum of the estimated noise signal. The estimated noise signal may be obtained based on the second representation by e.g.:

$$\hat{W}(\omega) = \frac{\hat{\sigma}_v^2}{\left|\hat{A}_w(\omega)\right|^2}, \tag{12}$$

where $\hat{A}_w(\omega)=\Sigma_{k=0}^{Q}\hat{a}_{w_k}e^{-j\omega k}$. The linear prediction coefficients, i.e. $a_s$ and $a_w$, determine the shape of the envelope of the corresponding estimated reference signal $\hat{S}(\omega)$ and of estimated noise signal $\hat{W}(\omega)$, respectively. The excitation variances, $\hat{\sigma}_u$ and $\hat{\sigma}_v$, determine the overall signal magnitude. Finally, the reconstructed noisy speech signal may be determined as a combined sum of the reference signal spectrum and the noise signal spectrum (or power spectrum), e.g.:

$$\hat{Y}(\omega)=\hat{S}(\omega)+\hat{W}(\omega). \tag{13}$$

The time-frequency spectra may replace the discrete Fourier transform of the reference speech signal and the noisy speech signal as input in a STOI estimator.

In one or more exemplary hearing devices, the speech intelligibility estimator comprises a short-time objective intelligibility estimator. The short-time objective intelligibility estimator may be configured to compare the reconstructed reference speech signal with the reconstructed noisy speech signal and to provide the speech intelligibility indicator, e.g. based on the comparison. For example, elements of the first representation of the first input signal (e.g. the spectra (or power spectra) of the noisy speech, $\hat{Y}$) may be clipped by a normalisation procedure expressed in Eq. 14 in order to de-emphasize the impact of region in which noise dominates the spectrum:

$$\hat{Y}' = \max\left(\min\left(\lambda\cdot\hat{Y}, \left(1+10^{-\frac{\beta}{20}}\right)\cdot\hat{S}\right), \left(1-10^{-\frac{\beta}{20}}\right)\cdot\hat{S}\right), \tag{14}$$

where $\hat{S}$ is the spectrum (or power spectrum) of the reconstructed reference signal, $\lambda=\sqrt{\Sigma\hat{S}^2/\Sigma\hat{Y}^2}$ is a scale factor for normalizing the noisy TF bins and $\beta=-15$ dB is e.g. the lower signal-to-distortion ratio. Given the local correlation coefficient, $r_f(t)$, between $\hat{Y}$ and $\hat{S}$ at frequency f and time t, the speech intelligibility indicator, SII, may be estimated by averaging across frequency bands and frames:

$$SII = \frac{1}{TF}\sum_{f=1}^{F}\sum_{t=1}^{T} r_f(t). \tag{15}$$

In one or more embodiments, the short-time objective intelligibility estimator may be configured to compare the reconstructed reference speech signal with the first input signal to provide the speech intelligibility indicator. In other words, the reconstructed noisy speech signal may be replaced by the first input signal as obtained from the input module. The first input signal may be captured by a single microphone (which is omnidirectional) or by a plurality of microphones (e.g. using beamforming). For example, the speech intelligibility indicator may be predicted by the controller or the speech intelligibility estimator by comparing the reconstructed speech signal and the first input signal using the STOI estimator, such as by comparing the correlation of the reconstructed speech signal and the first input signal using the STOI estimator.

In one or more exemplary hearing devices, the input module comprises a second microphone and a first beamformer. The first beamformer may be connected to the first microphone and the second microphone and configured to provide a first beamform signal, as the first input signal, based on first and second microphone signals. The first beamformer may be connected to a third microphone and/or a fourth microphone and configured to provide a first beamform signal, as the first input signal, based on a third microphone signal of the third microphone and/or a fourth microphone signal of the fourth microphone. The decomposition module may be configured to decompose the first beamform signal into the first representation. For example, the first beamformer may comprise a front beamformer or zero-direction beamformer, such as a beamformer directed to a front direction of the user.

In one or more exemplary hearing devices, the input module comprises a second beamformer. The second beamformer may be connected to the first microphone and the second microphone and configured to provide a second beamform signal, as a second input signal, based on first and second microphone signals. The second beamformer may be connected to a third microphone and/or a fourth microphone and configured to provide a second beamform signal, as the second input signal, based on a third microphone signal of the third microphone and/or a fourth microphone signal of the fourth microphone. The decomposition module may be configured to decompose the second input signal into a third representation. For example, the second beamformer may comprise an omni-directional beamformer.

The present disclosure also relates to a method of operating a hearing device. The method comprises converting audio to one or more microphone signals including a first input signal; and obtaining a speech intelligibility indicator indicative of speech intelligibility related to the first input signal. Obtaining the speech intelligibility indicator comprises obtaining a first representation of the first input signal in a frequency domain by determining one or more elements of the representation of the first input signal in the frequency domain using one or more characterization blocks.

In one or more exemplary methods, determining one or more elements of the first representation of the first input signal using one or more characterization blocks comprises mapping a feature of the first input signal into the one or more characterization blocks. In one or more exemplary methods, the one or more characterization blocks comprise one or more target speech characterization blocks. In one or more exemplary methods, the one or more characterization blocks comprise one or more noise characterization blocks.

In one or more exemplary methods, obtaining the speech intelligibility indicator comprises generating a reconstructed reference speech signal based on the first representation, and determining the speech intelligibility indicator based on the reconstructed reference speech signal.

The method may comprise controlling the hearing device based on the speech intelligibility indicator.

The figures are schematic and simplified for clarity. Throughout, the same reference numerals are used for identical or corresponding parts.

FIG. 1 is a block diagram of an exemplary hearing device 2 according to the disclosure.

The hearing device 2 comprises an input module 6 for provision of a first input signal 9. The input module 6 comprises a first microphone 8. The input module 6 may be configured to provide a second input signal 11. The first microphone 8 may be part of a set of microphones. The set of microphones may comprise one or more microphones. The set of microphones comprises a first microphone 8 for provision of a first microphone signal 9' and optionally a second microphone 10 for provision of a second microphone signal 11'. The first input signal 9 is the first microphone signal 9' while the second input signal 11 is the second microphone signal 11'.

The hearing device 2 optionally comprises an antenna 4 for converting a first wireless input signal 5 of a first external source (not shown in FIG. 1) to an antenna output signal. The hearing device 2 optionally comprises a radio transceiver 7 coupled to the antenna 4 for converting the antenna output signal to one or more transceiver input signals and to the input module 6 and/or the set of microphones comprising a first microphone 8 and optionally a second microphone 10 for provision of respective first microphone signal 9' and second microphone signal 11'.

The hearing device 2 comprises a processor 14 for processing input signals. The processor 14 provides an electrical output signal based on the input signals to the processor 14.

The hearing device comprises a receiver 16 for converting the electrical output signal to an audio output signal.

The processor 14 is configured to compensate for a hearing loss of a user and to provide an electrical output signal 15 based on input signals. The receiver 16 converts the electrical output signal 15 to an audio output signal to be directed towards an eardrum of the hearing device user.

The hearing device comprises a controller 12. The controller 12 is operatively connected to input module 6, (e.g. to the first microphone 8) and to the processor 14. The controller 12 may be operatively connected to the second microphone 10 if any. The controller 12 is configured to estimate the speech intelligibility indicator indicative of speech intelligibility based on one or more input signals, such as the first input signal 9. The controller 12 comprises a speech intelligibility estimator 12*a* for estimating a speech intelligibility indicator indicative of speech intelligibility based on the first input signal 9. The controller 12 is configured to control the processor 14 based on the speech intelligibility indicator.

The speech intelligibility estimator 12*a* comprises a decomposition module 12*aa* for decomposing the first input signal 9 into a first representation of the first input signal 9 in a frequency domain. The first representation comprises one or more elements representative of the first input signal 9. The decomposition module comprises one or more characterization blocks, A1, . . . , Ai for characterizing the one or more elements of the first representation in the frequency domain. In one or more exemplary hearing devices, the decomposition module 12*aa* is configured to decompose the first input signal 9 into the first representation by mapping a feature of the first input signal 9 into one or more characterization blocks A1, . . . , Ai. For example, the decomposition module is configured to map a feature of the first input signal 9 into one or more characterization blocks A1, . . . , Ai using an autoregressive model of the first input signal with linear prediction coefficients relating the frequency-based feature of the first input signal 9 to the one or more characterization blocks A1, . . . , Ai of the decomposition module 12*aa*. The feature of the first input signal 9 comprises for example a parameter of the first input signal, a frequency of the first input signal, a spectral envelop of the first input signal and/or a frequency spectrum of the first input signal. A parameter of the first input signal may be an auto-regressive, AR, coefficient of an auto-regressive model, such as the coefficients in Equation (1).

In one or more exemplary hearing devices, the decomposition module 12*aa* is configured to compare the feature with one or more characterization blocks A1, . . . , Ai and deriving the one or more elements of the first representation based on the comparison. For example, the decomposition module 12*aa* compares a frequency-based feature of the first input signal 9 with the one or more characterization blocks A1, . . . , Ai by estimating a minimum mean square error of the linear prediction coefficients and of excitation co-variances related to the first input signal 9 for each of the characterization blocks, as illustrated in Equation (4).

For example, the one or more characterization blocks A1, . . . , Ai may comprise one or more target speech characterization blocks. In one or more exemplary hearing devices, a characterization block may be an entry of a codebook or an entry of a dictionary. For example, the one or more target speech characterization blocks may form part of a target speech codebook in the frequency domain or a target speech dictionary in the frequency domain.

In one or more exemplary hearing devices, the one or more characterization blocks A1, . . . , Ai may comprise one or more noise characterization blocks. For example, the one or more noise characterization blocks A1, . . . , Ai may form part of a noise codebook in the frequency domain or a noise dictionary in the frequency domain.

The decomposition module 12*aa* may be configured to determine the second representation by comparing the feature of the first input signal with the one or more target speech characterization blocks and/the one or more noise characterization blocks and determining the one or more elements of the second representation based on the comparison. The second representation may be a noise signal representation while the first representation may be a reference signal representation.

For example, the decomposition module 12*aa* may be configured to determine the first representation and the second representation by comparing the feature of the first input signal with the one or more target speech characterization blocks and the one or more noise characterization blocks and determining the one or more elements of the first representation and the one or more elements of the second representation based on the comparisons, as illustrated in any of the Equations (5-10).

The hearing device may be configured to train the one or more characterization blocks, e.g. using a female voice, and/or a male voice.

The speech intelligibility estimator 12*a* may comprise a signal synthesizer 12*ab* for generating a reconstructed reference speech signal based on the first representation. The speech intelligibility estimator 12*a* may be configured to estimate the speech intelligibility indicator based on the reference reconstructed speech signal provided by the signal synthesizer 12*ab*. For example, a signal synthesizer 12*ab* is configured to generate the reconstructed reference speech signal based on the first representation, following e.g. Equations (11).

The signal synthesizer 12*ab* may be configured to generate a reconstructed noise signal based on the second representation, e.g. based on Equation (12).

The speech intelligibility indicator may be estimated based on the reconstructed noisy speech signal.

The speech intelligibility estimator 12*a* may comprise a short-time objective intelligibility (STOI) estimator 12*ac*. The short-time objective intelligibility estimator 12*ac* is configured to compare the reconstructed reference speech signal and a noisy input signal (either a reconstructed noisy input signal or the first input signal 9) and to provide the speech intelligibility indicator based on the comparison, as illustrated in Equations (13-15).

For example, the short-time objective intelligibility estimator 12*ac* compares the reconstructed reference speech signal and the noisy speech signal (reconstructed or not). In other words, the short-time objective intelligibility estimator 12*ac* assesses the correlation between the reconstructed reference speech signal and the noisy speech signal (e.g. the reconstructed noisy speech signal) and uses the assessed correlation to provide a speech intelligibility indicator to the controller 12, or to the processor 14.

Figure 2:
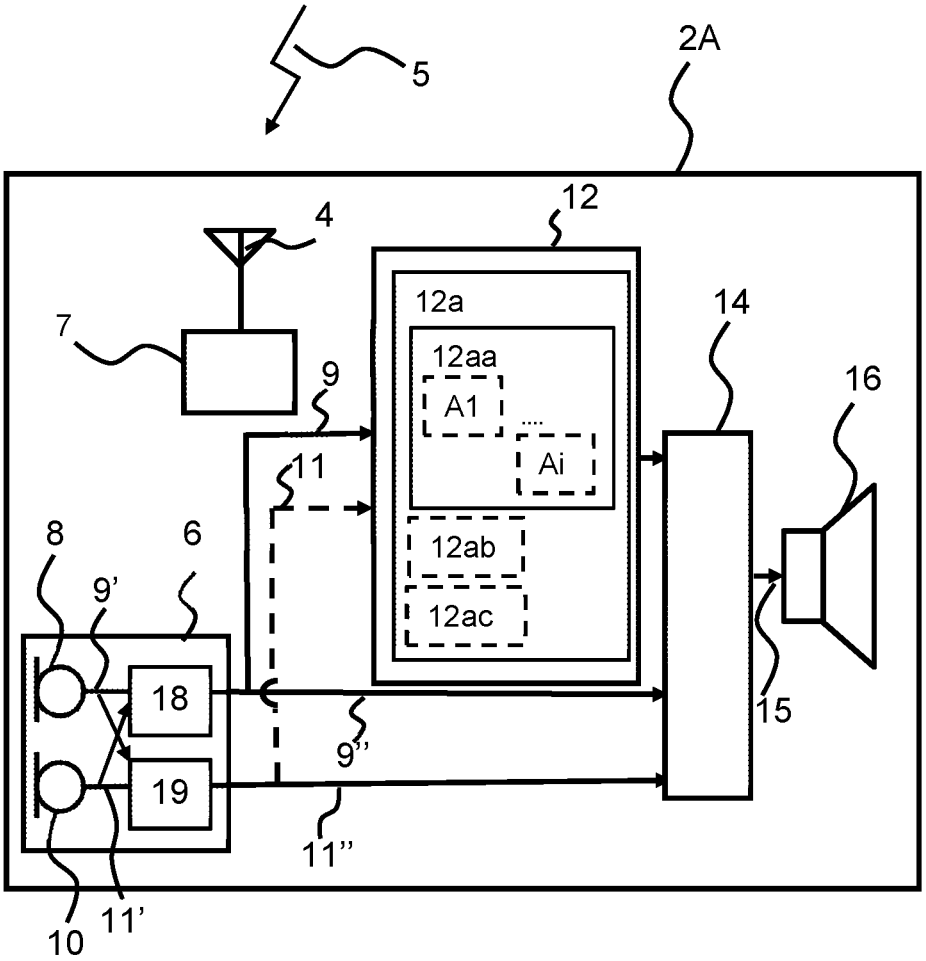

FIG. 2 is a block diagram of an exemplary hearing device 2A according to the disclosure wherein a first input signal 9 is a first beamform signal 9". The hearing device 2A comprises an input module 6 for provision of a first input signal 9. The input module 6 comprises a first microphone 8, a second microphone 10 and a first beamformer 18 connected to the first microphone 8 and to the second microphone 10. The first microphone 8 is part of a set of microphones which comprises a plurality microphones. The set of microphones comprises the first microphone 8 for provision of a first microphone signal 9' and the second microphone 10 for provision of a second microphone signal 11'. The first beamformer is configured to generate a first beamform signal 9" based on the first microphone signal 9' and the second microphone signal 11'. The first input signal 9 is the first beamform signal 9" while the second input signal 11 is the second beamform signal 11".

The input module 6 is configured to provide a second input signal 11. The input module 6 comprises a second beamformer 19 connected the second microphone 10 and to the first microphone 8. The second beamformer 19 is configured to generate a second beamform signal 11" based on the first microphone signal 9' and the second microphone signal 11'.

The hearing device 2A comprises a processor 14 for processing input signals. The processor 14 provides an electrical output signal based on the input signals to the processor 14.

The hearing device comprises a receiver 16 for converting the electrical output signal to an audio output signal.

The processor 14 is configured to compensate for a hearing loss of a user and to provide an electrical output signal 15 based on input signals. The receiver 16 converts the electrical output signal 15 to an audio output signal to be directed towards an eardrum of the hearing device user.

The hearing device comprises a controller 12. The controller 12 is operatively connected to input module 6, (i.e. to the first beamformer 18) and to the processor 14. The controller 12 may be operatively connected to the second beamformer 19 if any. The controller 12 is configured to estimate the speech intelligibility indicator indicative of speech intelligibility based on the first beamform signal 9". The controller 12 comprises a speech intelligibility estimator 12*a* for estimating a speech intelligibility indicator indicative of speech intelligibility based on the first beamform signal 9". The controller 12 is configured to control the processor 14 based on the speech intelligibility indicator.

The speech intelligibility estimator 12*a* comprises a decomposition module 12*aa* for decomposing the first beamform signal 9" into a first representation in a frequency domain. The first representation comprises one or more elements representative of the first beamform signal 9". The decomposition module comprises one or more characterization blocks, A1, . . . , Ai for characterizing the one or more elements of the first representation in the frequency domain.

The decomposition module 12*a* is configured to decompose the first beamform signal 9" into the first representation (related to the estimated reference speech signal), and optionally into a second representation (related to the estimated noise signal) as illustrated in Equations (4-10).

When a second beamformer is included in the input module 6, the decomposition module may be configured to decompose the second input signal 11" into a third representation (related to the estimated reference speech signal) and optionally a fourth representation (related to the estimated noise signal).

The speech intelligibility estimator 12*a* may comprise a signal synthesizer 12*ab* for generating a reconstructed reference speech signal based on the first representation, e.g. in Equation (11). The speech intelligibility estimator 12*a* may be configured to estimate the speech intelligibility indicator based on the reconstructed reference speech signal provided by the signal synthesizer 12*ab*.

The speech intelligibility estimator 12*a* may comprise a short-time objective intelligibility (STOI) estimator 12*ac*. The short-time objective intelligibility estimator 12*ac* is configured to compare the reconstructed reference speech signal and a noisy speech signal (e.g. reconstructed or directly obtained from the input module) and to provide the speech intelligibility indicator based on the comparison. For example, the short-time objective intelligibility estimator 12*ac* compares the reconstructed speech signal (e.g. the reconstructed reference speech signal) and noisy speech signal (e.g. reconstructed or directly obtained from the input module). In other words, the short-time objective intelligibility estimator 12*ac* assesses the correlation between the reconstructed reference speech signal and the noisy speech signal (e.g. the reconstructed noisy speech signal or input signal) and uses the assessed correlation to provide a speech intelligibility indicator to the controller 12, or to the processor 14.

In one or more exemplary hearing devices, the decomposition module 12*aa* is configured to decompose the first input signal 9 into the first representation by mapping a feature of the first input signal 9 into one or more characterization blocks A1, . . . , Ai. For example, the decomposition module is configured to map a feature of the first input signal 9 into one or more characterization blocks A1, . . . , Ai using an autoregressive model of the first input signal with linear prediction coefficients relating the frequency-based feature of the first input signal 9 to the one or more characterization blocks A1, . . . , Ai of the decomposition module 12*aa*. The feature of the first input signal 9 comprises for example a parameter of the first input signal, a frequency of the first input signal, a spectral envelop of the first input signal and/or a frequency spectrum of the first input signal. A parameter of the first input signal may be an auto-regressive, AR, coefficient of an auto-regressive model.

In one or more exemplary hearing devices, the decomposition module 12*aa* is configured to compare the feature with one or more characterization blocks A1, . . . , Ai and deriving the one or more elements of the first representation based on the comparison. For example, the decomposition module 12*aa* compares a frequency-based feature of the first input signal 9 with the one or more characterization blocks A1, . . . , Ai by estimating a minimum mean square error of the linear prediction coefficients and of excitation co-variances related to the first input signal 9 for each of the characterization blocks, as illustrated in Equation (4).

For example, the one or more characterization blocks A1, . . . , Ai may comprise one or more target speech characterization blocks. For example, the one or more target speech characterization blocks may form part of a target speech codebook in the frequency domain or a target speech dictionary in the frequency domain.

In one or more exemplary hearing devices, a characterization block may be an entry of a codebook or an entry of a dictionary.

In one or more exemplary hearing devices, the one or more characterization blocks may comprise one or more noise characterization blocks. For example, the one or more noise characterization blocks may form part of a noise codebook in the frequency domain or a noise dictionary in the frequency domain.

Figure 3:
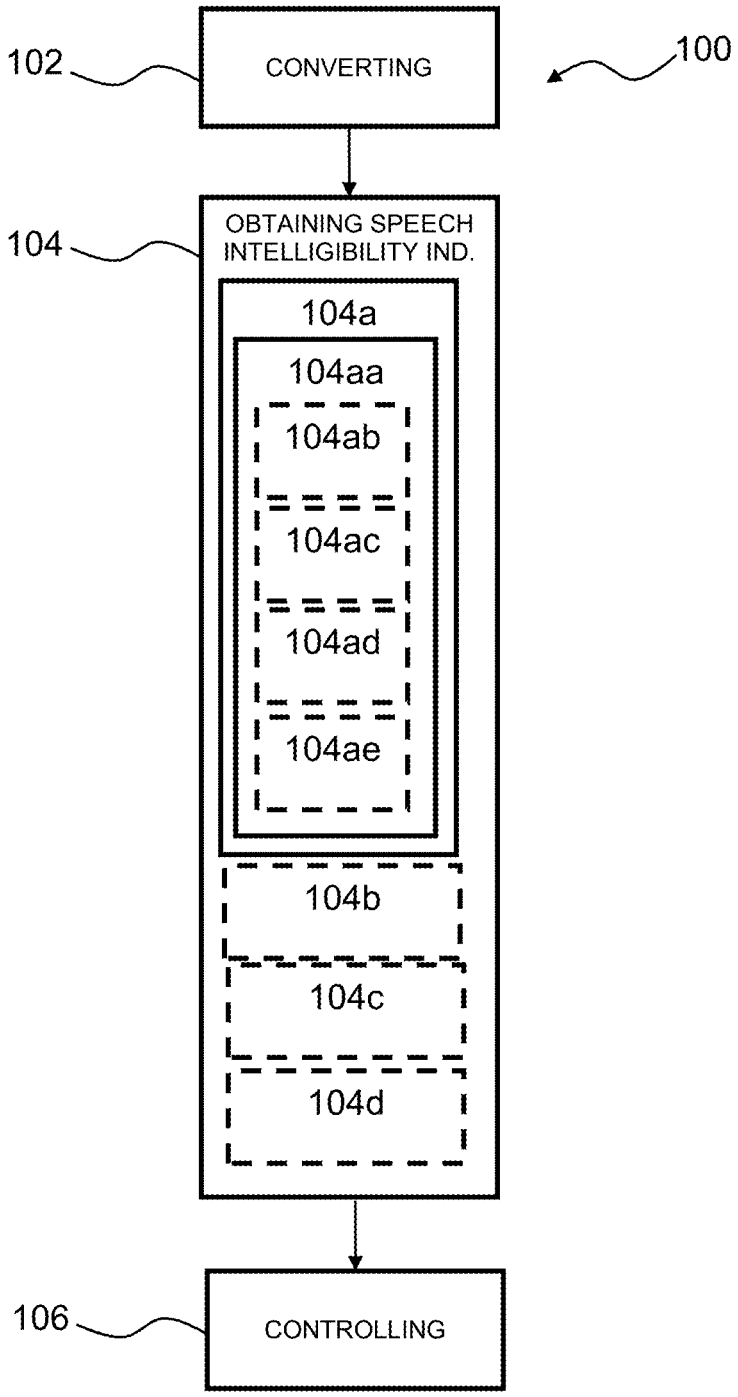
FIG. 3 is a flow diagram of an exemplary method for operating a hearing device according to the disclosure, and FIG. 4 are graphs illustrating exemplary intelligibility performance results of the disclosed technique compared to the intrusive STOI technique.

FIG. 3 shows a flow diagram of an exemplary method of operating a hearing device according to the disclosure. The method 100 comprises converting 102 audio to one or more microphone input signals including a first input signal; and obtaining 104 a speech intelligibility indicator indicative of speech intelligibility related to the first input signal. Obtaining 104 the speech intelligibility indicator comprises obtaining 104*a* a first representation of the first input signal in a frequency domain by determining 104*aa* one or more elements of the representation of the first input signal in the frequency domain using one or more characterization blocks.

In one or more exemplary methods, determining 104*aa* one or more elements of the first representation of the first input signal using one or more characterization blocks comprises mapping 104*ab* a feature of the first input signal into the one or more characterization blocks. For example, mapping 104*ab* a feature of the first input signal into one or more characterization blocks may be performed using an autoregressive model of the first input signal with linear prediction coefficients relating the frequency-based feature of the first input signal to the one or more characterization blocks of the decomposition module.

In one or more exemplary methods, mapping 104*ab* the feature of the first input signal into the one or more characterization blocks may comprise comparing the feature with one or more characterization blocks and deriving the one or more elements of the first representation based on the comparison. For example, comparing a frequency-based feature of the first input signal with the one or more characterization blocks may comprise estimating a minimum mean square error of the linear prediction coefficients and of excitation co-variances related to the first input signal for each of the characterization blocks.

In one or more exemplary methods, the one or more characterization blocks comprise one or more target speech characterization blocks. In one or more exemplary methods, the one or more characterization blocks comprise one or more noise characterization blocks.

In one or more exemplary methods, the first representation may comprise a reference signal representation.

In one or more exemplary methods, determining 104*aa* one or more elements of the first representation of the first input signal using one or more characterization blocks may comprise determining 104*ac* the one or more elements of the reference signal representation as estimated coefficients related to an estimated reference speech signal for each of the one or more of the characterization blocks (e.g. target speech characterization blocks). For example, mapping a feature of the estimated reference speech signal into one or more characterization blocks (e.g. target speech characterization blocks) may be performed using an autoregressive model of the first input signal with linear prediction coefficients relating a frequency-based feature of the estimated reference speech signal to the one or more characterization blocks (e.g. target speech characterization blocks). For example, mapping a frequency-based feature of the estimated reference speech signal to the one or more characterization blocks (e.g. target speech characterization blocks) may comprise estimating a minimum mean square error of the linear prediction coefficients and of excitation co-variances related to estimated reference speech signal for each of the one or more characterization blocks (e.g. target speech characterization blocks).

In one or more exemplary methods, determining 104*aa* one or more elements of the first representation may comprise comparing 104*ad* the feature of the first input signal with the one or more target speech characterization blocks and/or the one or more noise characterization blocks and determining 104*ae* the one or more elements of the first representation based on the comparison.

In one or more exemplary methods, obtaining 104 the speech intelligibility indicator may comprise obtaining 104*b* a second representation of the first input signal, wherein the second representation comprises one or more elements representative of the first input signal. Obtaining 104*b* the second representation of the first input signal may be performed using one or more characterization blocks for characterizing the one or more elements of the second representation. In one or more exemplary methods, the second representation may comprise a representation of a noise signal, such as a noise signal representation.

In one or more exemplary methods, obtaining 104 the speech intelligibility indicator comprises generating 104*c* a reconstructed reference speech signal based on the first representation, and determining 104*d* the speech intelligibility indicator based on the reconstructed reference speech signal.

The method may comprise controlling 106 the hearing device based on the speech intelligibility indicator.

Figure 4:
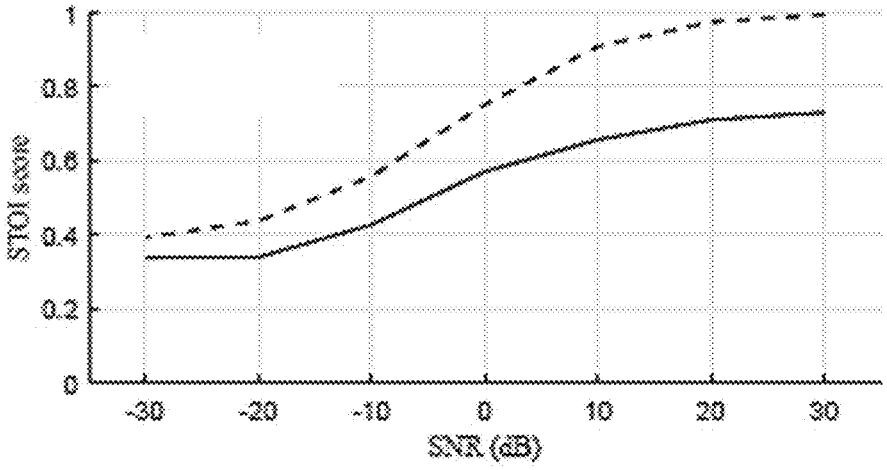

FIG. 4 shows exemplary intelligibility performance results of the disclosed technique compared to the intrusive STOI technique. The intelligibility performance results of the disclosed technique are shown in FIG. 4 as a solid line while the intelligibility performance results of the intrusive STOI technique are shown as a dash line. The performance results are presented using a STOI score as a function of signal to noise ratio, SNR.

The intelligibility performance results shown in FIG. 4 are evaluated on speech samples from of 5 male speakers and 5 female speakers from the EUROM_1 database of the English sentence corpus. The interfering additive noise signal is simulated in the range of −30 to 30 dB SNR as multi-talker babble from the NOIZEUS database. The linear prediction coefficients and variances of both the reference speech signal and the noise signal are estimated from 25.6 ms frames with sampling frequency 10 kHz. The reference speech signal and, thus, the STP (short term predictor) parameters are assumed to be stationary over very short frames. The autoregressive model order P and Q of both the reference speech and noise, respectively, is set to 14. The speech codebook is generated on a training sample of 15 minutes of speech from multiple speakers in the EUROM_1 database to assure a generic speech model using the generalized Lloyd algorithm. The training sample of the target speech characterization blocks (e.g. target speech codebook) does not include speech samples from the speakers used in the test set. The noise characterization blocks (e.g. noise codebook) are trained on 2 minutes of babble talk. The sizes of the target speech and noise codebooks are $N_s$=64 and $N_w$=8, respectively.

The simulations show a high correlation between the disclosed non-intrusive technique and the intrusive STOI indicating that the disclosed technique is a suitable metric for automatic classification of speech signals. Further, these performance results also support that the representation disclosed herein provides a cue sufficient for accurately estimating speech intelligibility.

The use of the terms "first", "second", "third" and "fourth", etc. does not imply any particular order, but are included to identify individual elements. Moreover, the use of the terms first, second, etc. does not denote any order or importance, but rather the terms first, second, etc. are used to distinguish one element from another. Note that the words first and second are used here and elsewhere for labelling purposes only and are not intended to denote any specific spatial or temporal ordering. Furthermore, the labelling of a first element does not imply the presence of a second element and vice versa.

Although particular features have been shown and described, it will be understood that they are not intended to limit the claimed invention, and it will be made obvious to those skilled in the art that various changes and modifications may be made without departing from the spirit and scope of the claimed invention. The specification and drawings are, accordingly to be regarded in an illustrative rather than restrictive sense. The claimed invention is intended to cover all alternatives, modifications, and equivalents.

LIST OF REFERENCES

2 hearing device
2A hearing device
4 antenna
5 first wireless input signal
6 input module
7 radio transceiver
8 first microphone
9 first input signal
9' first microphone signal
9" first beamform signal
10 second microphone
11 second input signal
11' second microphone signal
11" second beamform signal
12 controller
12*a* speech intelligibility estimator
12*aa* decomposition module
12*ab* signal synthesizer
12*ac* short-time objective intelligibility (STOI) estimator
A1 . . . Ai one or more characterization blocks
14 processor
16 receiver
18 first beamformer
19 second beamformer
100 method of operating a hearing device
102 converting audio to one or more microphone input signals
104 obtaining a speech intelligibility indicator
104*a* obtaining a first representation
104*aa* determining one or more elements of the representation of the first input signal in the frequency domain using one or more characterization blocks

104*ab* mapping a feature of the first input signal into the one or more characterization blocks

104*ac* determining the one or more elements of the reference signal representation as estimated coefficients related to an estimated reference speech signal for each of the one or more of the characterization blocks

104*ad* comparing the feature of the first input signal with the one or more target speech characterization blocks and/or the one or more noise characterization blocks

104*ae* determining the one or more elements of the first representation based on the comparison

104*b* obtaining a second representation

104*c* generating a reconstructed reference speech signal based on the first representation

104*d* determining the speech intelligibility indicator based on the reconstructed reference speech signal

106 controlling the hearing device based on the speech intelligibility indicator

The invention claimed is:

1. A hearing device comprising:

an input module for provision of a first input signal, the input module comprising a first microphone;

a processor configured to provide an electrical output signal based on the first input signal;

a receiver configured to provide an audio output signal based on the electrical output signal; and a controller operatively connected to the input module, the controller comprising a speech intelligibility estimator configured to determine a speech intelligibility indicator indicative of speech intelligibility, wherein the controller is configured to control the processor based on the speech intelligibility indicator;

wherein the hearing device is configured to decompose the first input signal into a first representation of the first input signal based on one or more characterization blocks of a speech codebook, and/or based on one or more characterization blocks of a noise codebook, and wherein the hearing device is configured to determine a reference speech signal based on the first representation; and wherein the speech intelligibility estimator comprises a short-time objective intelligibility (STOI) estimator that is configured to use the reference speech signal determined based on the first representation decomposed from the first input signal to obviate a need for the STOI estimator to use an intrusive clean speech signal.

2. The hearing device according to claim 1, wherein the hearing device is configured to decompose the first input signal into the first representation by mapping a feature of the first input signal to at least one of the one or more characterization blocks of the speech codebook and/or to at least one of the one or more characterization blocks of the noise codebook.

3. The hearing device according to claim 1, wherein the one or more characterization blocks of the speech codebook comprise one or more target speech characterization blocks.

4. The hearing device according to claim 1, wherein the one or more characterization blocks of the noise codebook comprise one or more noise characterization blocks.

5. The hearing device according to claim 1, wherein the hearing device is configured to decompose the first input signal into the first representation by comparing one or more features of the first input signal with the one or more characterization blocks of the speech codebook and/or the one or more characterization blocks of the noise codebook, and determining the one or more elements of the first representation based on the comparison.

6. The hearing device according to claim 1, wherein the hearing device is configured to determine a second representation of the first input signal.

7. The hearing device according to claim 1, wherein the speech codebook is based on a training sample.

8. A method performed by a hearing device, the method comprising:

converting sound to one or more microphone signals including a first input signal, the first input signal comprising a noisy speech signal;

determining a speech intelligibility indicator indicative of speech intelligibility related to the first input signal; and controlling a processing unit of the hearing device based on the speech intelligibility indicator;

wherein the method further comprises determining a reference speech signal based on the noisy speech signal, wherein the reference speech signal is determined also based on one or more characterization blocks of a speech codebook, and/or based on one or more characterization blocks of a noise codebook; and wherein the speech intelligibility indicator is determined by a short-time objective intelligibility (STOI) estimator that is configured to use the reference speech signal determined based on the noisy speech signal to obviate a need for the STOI estimator to use an intrusive clean speech signal.

9. The method according to claim 8, wherein the act of determining the reference speech signal comprises mapping a feature of the first input signal to at least one of the one or more characterization blocks of the speech codebook and/or to at least one of the one or more characterization blocks of the noise codebook.

10. The method according to claim 8, wherein the one or more characterization blocks of the speech codebook comprise one or more target speech characterization blocks.

11. The method according to claim 8, wherein the one or more characterization blocks of the noise codebook comprise one or more noise characterization blocks.

12. The hearing device according to claim 1, wherein the first representation comprises a spectral envelope.

13. The hearing device according to claim 12, wherein the spectral envelope is parameterized via linear prediction coefficients.

14. The hearing device according to claim 1, wherein the first representation of the first input signal comprises a speech component and/or a noise component.

15. The method according to claim 8, wherein the act of determining the reference speech signal comprises determining a spectral envelope associated with the first input signal.

16. The method according to claim 8, wherein the act of determining the reference speech signal comprises decomposing the first input signal into a speech signal and a noise signal.

17. A hearing device comprising:

an input module for provision of a first input signal, the input module comprising a first microphone;

a processor configured to provide an electrical output signal based on the first input signal;

a receiver configured to provide an audio output signal based on the electrical output signal; and a controller operatively connected to the input module, the controller comprising a speech intelligibility estimator configured to determine a speech intelligibility indicator indicative of speech intelligibility, wherein the controller is configured to control the processor based on the speech intelligibility indicator;

wherein the hearing device is configured to determine a reference speech signal based on a noisy speech signal and based on one or more characterization blocks; and wherein the speech intelligibility estimator comprises a short-time objective intelligibility (STOI) estimator that is configured to use the reference speech signal determined based on the noisy speech signal to obviate a need for the STOI estimator to use an intrusive clean speech signal.

18. The hearing device of claim 17, wherein the first input signal comprises the noisy speech signal.

19. The hearing device of claim 18, wherein the hearing device is configured to decompose the first input signal into a representation of the first input signal, and wherein the hearing device is configured to determine the reference speech signal by constructing the reference speech signal based on the representation.

20. The hearing device of claim 19, wherein the representation of the first input signal comprises a spectral envelope.

21. The hearing device of claim 19, wherein the representation of the first input signal comprises elements in a frequency domain.

22. The hearing device of claim 17, wherein the STOI estimator is configured to compare the reference speech signal with the noisy speech signal or with a constructed noisy speech signal.

23. The hearing device of claim 17, wherein the one or more characterization blocks comprise one or more target speech characterization blocks, and/or one or more noise characterization blocks.

24. The hearing device of claim 17, further comprising a speech code book, wherein at least one of the one or more characterization blocks is a part of the speech code book.

25. The hearing device of claim 17, further comprising a noise code book, wherein at least one of the one or more characterization blocks is a part of the noise code book.

26. The hearing device of claim 17, wherein the hearing device is configured to decompose the first input signal by mapping a feature of the first input signal to at least one of the one or more characterization blocks.

27. The method of claim 8, wherein the act of determining the reference speech signal comprises determining components associated with the first input signal, and constructing the reference speech signal based on the components associated with the first input signal.

28. The method of claim 8, wherein the act of determining the speech intelligibility indicator comprises comparing, by the STOI estimator, the reference speech signal with the noisy speech signal or with a constructed noisy speech signal.

29. The hearing device of claim 1, wherein the first input signal comprises a noisy speech signal, and wherein the STOI estimator is configured to compare the reference speech signal with the noisy speech signal or with a constructed noisy speech signal.

* * * * *